US010112749B2

(12) United States Patent
Iyer et al.

(10) Patent No.: US 10,112,749 B2
(45) Date of Patent: Oct. 30, 2018

(54) CLOSURE ASSEMBLY FOR A CONTAINER

(71) Applicant: Conopco, Inc., Englewood Cliffs, NJ (US)

(72) Inventors: Nurani Dharmaraj Krishnaprakash Iyer, Kandivili West (IN); Wei Dong, Shanghai (CN); Garen Kouyoumjian, Leamington Spa (GB); Andrew Gordon Wallace, Northampton (GB); Sophie Louise Sladen, Leamington Spa (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/577,447

(22) PCT Filed: May 10, 2016

(86) PCT No.: PCT/EP2016/060431

§ 371 (c)(1),
(2) Date: Nov. 28, 2017

(87) PCT Pub. No.: WO2016/198219

PCT Pub. Date: Dec. 15, 2016

(65) Prior Publication Data

US 2018/0148235 A1 May 31, 2018

(30) Foreign Application Priority Data

Jun. 8, 2015 (WO) ..... PCT/CN2015/081010
Aug. 10, 2015 (EP) ..... 15180411

(51) Int. Cl.
*B65D 47/28* (2006.01)
*B65D 41/18* (2006.01)

(52) U.S. Cl.
CPC ..... *B65D 47/286* (2013.01); *B65D 41/18* (2013.01)

(58) Field of Classification Search
CPC ... B65D 47/286; B65D 41/18; B65D 43/0204
(Continued)

(56) References Cited

U.S. PATENT DOCUMENTS 2,434,706 A * 1/1948 Malyszko ..... B65D 47/286 220/345.3
6,098,834 A * 8/2000 Hatsumoto ..... B65D 47/249 220/212.5

(Continued)

FOREIGN PATENT DOCUMENTS

EP 0196250 10/1986
GB 1094588 12/1967

(Continued)

OTHER PUBLICATIONS

Search Report and Written Opinion in EP15180411, dated Oct. 13, 2015.

(Continued)

*Primary Examiner* — Vishal Pancholi
(74) *Attorney, Agent, or Firm* — Karen E. Klumas

(57) ABSTRACT

The invention relates to a closure assembly (1) for a container (2) and a container thereof. The invention more particularly relates to a closure assembly which provides leak tight closure for liquid or viscous products and can be simply opened or closed with minimal effort and additionally can be inverted to stably rest on a horizontal surface to act as a tottle.

15 Claims, 4 Drawing Sheets

(58) Field of Classification Search
USPC ..... 222/531, 537, 548, 556, 561, 562, 563; 220/62.12, 203.12, 203.17, 222, 252, 220/254.1, 254.3, 254.7, 254.9, 592.16, 220/780, 812, 813
See application file for complete search history.

(56) References Cited

U.S. PATENT DOCUMENTS

| | | | | |
|---|---|---|---|---|
| 6,752,287 | B1 * | 6/2004 | Lin | A47G 19/2272 220/254.9 |
| 8,074,849 | B2 * | 12/2011 | Domoy | B65D 47/2006 222/556 |
| 8,875,955 | B2 * | 11/2014 | Arora | A45D 40/04 222/386 |
| 9,145,238 | B2 * | 9/2015 | Barreto | B65D 43/022 |
| 9,181,018 | B2 * | 11/2015 | Betts | B05B 11/0032 |
| 9,181,019 | B2 * | 11/2015 | Betts | B65D 83/205 |
| 9,321,065 | B2 * | 4/2016 | Betts | B65D 83/205 |
| 9,351,597 | B2 * | 5/2016 | Liu | B65D 43/02 |
| 9,364,110 | B2 * | 6/2016 | George | A47G 19/2272 |
| 9,394,096 | B2 * | 7/2016 | Betts | B65D 83/205 |
| 2002/0125274 | A1 * | 9/2002 | Beecroft | B65D 47/2006 222/536 |
| 2014/0231467 | A1 * | 8/2014 | Betts | B05B 11/0032 222/402.11 |
| 2014/0299600 | A1 * | 10/2014 | Chevalier | A45D 34/00 220/254.9 |

FOREIGN PATENT DOCUMENTS

| | | |
|---|---|---|
| JP | 50146951 | 12/1975 |
| JP | 2111646 | 9/1990 |
| JP | 2011111224 | 6/2011 |
| WO | WO2013061003 | 5/2013 |

OTHER PUBLICATIONS

Search Report and Written Opinion in PCTEP2016060431, dated Jul. 13, 2016.

* cited by examiner

CLOSURE ASSEMBLY FOR A CONTAINER

FIELD OF THE INVENTION

The invention relates to a closure assembly for a container and a container thereof. The invention more particularly relates to a closure assembly which provides leak tight closure for liquid or viscous products and can be simply opened or closed with minimal effort and additionally can be inverted to stably rest on a horizontal surface to act as a tottle.

BACKGROUND OF THE INVENTION

Containers come in various sizes and shapes. Containers for products for use in homes e.g. those for home care, personal care and foods come in relatively small sizes e.g. with a volume of from a few milliliters to a few liters. Products in these categories that are used to store and dispense liquid or viscous products e.g. those in watery, emulsion, lotion, gel, cream or semi solid forms require dispensing ports that are designed with closures that have to be leaktight when in the closed positions and dispense freely when in the open position. Further, the closures have to be relatively easy to operate such that the user does not have to use undue pressure, while at the same time, the closure in the closed position does not cause leakage of the material from the container.

Several types of closures are known and have been used for dispensing products from such containers. Well known closures are of the threaded screw, flip-top, friction fit, snap-fit, or gated closure types, among several others. The present invention relates to closures for bottles that dispense products for home or personal care especially personal care e.g. in dispensing liquids and viscous products like shampoos, conditioners, personal wash liquids and lotions. The bottles may also be used for storage and dispensing of cleansing products for homes and furnishings. The closure of the present invention is of the slider type where a disc shaped element reversibly slides on top of the dispensing port of the container, thereby enabling opening and closing of the dispensing port. Such a type of closure has been disclosed in the past. GB1094588A discloses a container closure which comprises a plastics part spherical valve member having an integral pin press-fitted into and slidable along a radial slot of a correspondingly shaped part-spherical depression in a boss on the top of a container. The valve may be slidden to a position generally parallel to the container top, so that its pin is parallel to the main axis of the container, when it closes the dispensing opening. The valve member acts as a pouring spout. The container top may be of tin, plastics or waxed cardboard.

There is a need in the art to provide for a closure assembly that is easy to operate with a simple horizontal push of the thumb or a finger which ensures leak tight opening and closing of the container dispensing port. Further, in a preferred aspect, the top of the container closure assembly is configured that it can be inverted to be stably placed on a table top to act like a tottle.

A tottle is a container, generally elongated that can be placed stably on its bottom surface on a horizontal plane like any normal bottle. A tottle, additionally, is so configured that the bottle can be inverted and placed stably on its top surface on a horizontal plane. This is especially useful when the contents of the container are very less and it takes a long time for the user to invert and shake the container so as to dispense the remaining contents, which is especially difficult when the contents are very viscous. A tottle, in such a circumstance will be placed on its head so that the contents are collected towards the dispensing end of the container, so that the user can dispense the contents without too much effort.

None of the prior known or published container closure systems including GB1094588 disclose all of the above desired advantages where the container can be used as a bottle or a tottle, has a closure system that is easy to push open and close with a simple horizontal push of the thumb and provides leak proof closing of the outlet port of the container even after continued use of the system for a long time.

It is thus an object of the present invention to provide for a closure system for a container that is easy for the consumer to open and close with a simple horizontal movement using the thumb or a finger.

It is another object of the present invention to provide for a closure system for a container that is easy for the consumer to open and close with a simple horizontal movement using the thumb or a finger while being leakproof every time the closure is closed after use.

It is yet another object of the present invention to provide for a closure system for a container that is easy for the consumer is open and close, is leakproof on closing and can additionally be used as a tottle.

SUMMARY OF THE INVENTION

The first aspect of the present invention relates to a closure assembly for a container to be mounted on a container body comprising (a) a container head;

(b) a disc shaped cap; and (c) a closure strip juxtaposed between said container head and said disc shaped cap;

the container head having upwardly extending walls and a top surface comprising a curved depressed portion comprising an outlet port in fluid communication with said container body; said top surface provided with a pair of parallel tracks and a pair of parallel recesses;

the disc shaped cap provided at its bottom surface with two pairs of parallel railings and a centrally aligned monorail; the first pair of parallel railings slidably engagable with said pair of parallel tracks; the second pair of parallel railings provided with rectangular cutouts; and the centrally aligned monorail is configured to have an arcuate profile;

the closure strip comprising on its upper surface with a longitudinal recess slidably engagable with said arcuate monorail; the closure strip comprising on its lower surface at a distal section with a pair of legs slidably engagable with said pair of parallel recesses and at a proximal section with a plug capable of closing the outlet port; the closure strip provided on its side edges with a pair of ears capable of sliding from one end of said rectangular cutouts to the other;

such that when the disc shaped cap is slid over the top surface of the container head from an open position, the arcuate profile of the monorail causes the closure strip to horizontally slide as well as vertically pivot downward to position the plug to close the outlet port and is capable of reversing its path in the opposite direction.

Another aspect of the present invention relates to a container comprising a container body and a closure assembly of the first aspect adapted to be releasably engagable to each.

The invention will now be illustrated in relation to a non-limiting exemplary embodiment that is intended to enable one to visualize the various specific elements being described and is not intended to limit the invention in any way.

DETAILED DESCRIPTION OF THE INVENTION

Figure 1:
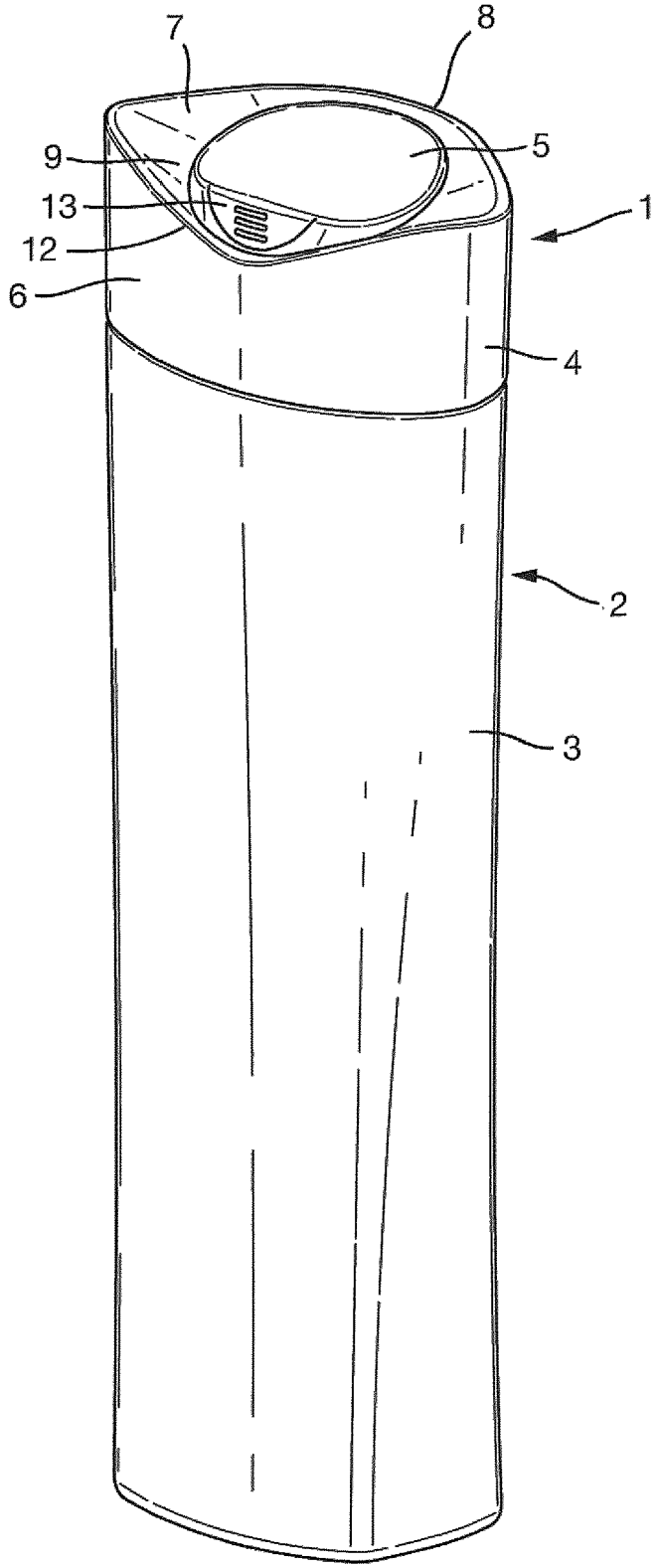
FIG. 1 is a perspective view of the container comprising the closure assembly mounted on the container body.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the embodiments illustrated and the examples given in the description below are intended to clarify the invention and are not intended to limit the invention to those embodiments and examples per se.

Except in the operating and comparative examples, or where otherwise explicitly indicated, all numbers in this description indicating amounts of material or conditions of a method, physical properties of materials and/or use are to be understood as modified by the word "about". Unless specified otherwise, numerical ranges expressed in the format "from x to y" are understood to include x and y. When for a specific feature multiple preferred ranges are described in the format "from x to y", it is understood that all ranges combining the different endpoints are also contemplated.

An advantage of the closure assembly of the present invention is that it is suitable for enabling closure in an axial direction while manual actuation of the closure is in the radial direction. A further advantage of the present invention is that resilient members that are used as closure elements often suffer from the disadvantage of having high shrinkage at low temperatures. With the use of a closure strip of the present invention with a material of construction having similar physical property to the container body, it is possible to overcome the above shrinkage problem.

The present invention relates to a closure assembly for a container, adapted to be mounted on a container body. The container is preferably elongate. The container body is also preferably elongate meaning that the longitudinal dimension of the container body is longer than the lateral dimension. The cross-section of the container body could be of any suitable shape like circular, oval, polygonal or any other arcuate shape. It could also be designed to have a cross section that is different along the length of the container body. The container body is preferably made of polymeric material, more preferably of a rigid plastic which may be selected from polypropylene (PP), polyethylene terephthalate (PET) or high density polyethylene (HDPE), and is most preferably HDPE.

The closure assembly comprises a container head, a disc shaped cap and a closure strip juxtaposed between the container head and the disc shaped cap. The container head has upwardly extending walls and a top surface and an edge there between.

The container head therefore has an inverted cup shape. The container head preferably has a cross-section at its lower end that is adapted to engage with the top end of the container body and more preferably the cross-section at its lower end is the same as that of the cross section of the top end of container body. The container head has a top surface which comprises a curved depressed portion comprising an outlet port in fluid communication with container body. The outlet port is preferably at the lowermost point of the depressed portion. The outlet port could be of any preferred shape, preferred ones being circular, oval, square or rectangular, most preferred shape being circular. The top surface of the container head is provided with a pair of parallel tracks and a pair of parallel recesses. Said pair of parallel tracks are collinear with and preferably aligned exterior to said pair of recesses. The container head is preferably polymeric, more preferably made of rigid plastic and may be chosen from one of PP or HDPE and is most preferably made of PP.

The disc shaped cap is provided at its bottom surface with two pairs of parallel railings and a centrally aligned monorail. The first of the above mentioned pair of parallel railings is slidably engagable with the pair of parallel tracks provided on the top surface of the container head. The second pair of parallel railings provided at the bottom surface of the disc shaped cap are given a rectangular cutout each. It is preferred that the rectangular cutouts on each of the railings extends over less than 50% of the length of the second pair of railings. The two pairs of parallel tracks are mutually collinear, with the first pair of parallel tracks aligned exterior to the second pair of parallel tracks.

The bottom surface of the disc shaped cap has a centrally aligned monorail that is configured to have an arcuate profile in the vertical plane. The disc shaped cap is preferably substantially circular in cross-section. It is preferred that the centrally aligned monorail extends over less than 50% of the diameter of the disc shaped cap when the disc shaped cap is circular. In an alternate aspect the centrally aligned monorail extends over less than 50% of the leading dimension of the disc shaped cap when it has a shape other than a circular shape. It is further preferred that the length of the monorail is longer than the length of the rectangular cutouts on the second pair of railings.

The closure strip is juxtaposed between the disc shaped cap and the container head. The closure strip is preferably an elongate rectangular strip having a preferred rectangular cross section. The closure strip comprises on its upper surface a longitudinal recess slidably engagable with the arcuate monorail provided on the bottom surface of the disc shaped cap. The closure strip comprises on its lower surface at a distal end with a pair of legs which are slidably engagable with the pair of parallel recesses provided on the container head. At the other longitudinal proximal end of the closure strip, on the bottom surface is provided a plug capable of closing the outlet port provided on the container head. The closure strip is provided on its side edges with a pair of ears capable of sliding from one end of the rectangular cutouts of second pair of railings to the other end. The pair of ears on the side edges of the closure strip are preferably positioned adjacent to the pair of legs which are provided on the bottom of the closure strip. It is preferred that the outlet port on the container head and the plug on the closure strip are both substantially circular. In the closed position, the plug is configured to sit flush within the outlet port, thereby providing leak proof closing of the container. The closure strip is preferably polymeric, more preferably made of glass filled polypropylene, polyamide or any engineering plastic and most preferably made of polyamide.

The edge of the container head defined by the border line between its upwardly extending walls and its top surface preferably comprises a v-shaped portion extending downwardly into a portion of the wall of the container head. The presence of the v-shaped portion as part of the edge to facilitate convenient movement of the disc shaped cap makes it difficult to configure the container to also act like a tottle. This problem can be overcome by preferably ensuring that at least 50%, more preferably at least 70% of the perimeter of the edge is at a substantially horizontal level. This aspect along with the others described above ensures that not only is the container closure easy to open and close while ensuring leak tightness, the container is also capable of being used as a tottle. It is preferred that the vertical distance as defined in the v-shaped portion is less than 50% of the maximum height of the upwardly extending wall of the container head. It is preferred that the v-shaped portion constitutes less than 50% of the perimeter of the edge, preferably less than 40%. It is further particularly preferred that the v-shape has an angle between 90 and 150 degrees.

The disc shaped cap preferably comprises a raised portion at one of its circumferential ends. The raised portion is preferably positioned in line with and posterior to the v-shaped portion of the container head. With this construction, where the raised portion is positioned just posterior to the v-shaped portion, and on the same side of the closure assembly, the disc shaped cap can be conveniently slid using a thumb in a horizontal direction through the v-shaped portion of the container head. The advantage of such a configuration as compared to past sliding assembly closures is that the elements of the closure assembly defined above enable a simple movement of the disc in substantially the horizontal direction with the thumb which makes the opening and closing very convenient for the user. As compared to this, closure assemblies disclosed and used in the past have to be pushed in a direction which is initially horizontal and as the disc moves the thumb has to be pushing in a direction between partly horizontal and partly vertical which leaves the consumer having to exert more pressure than is necessary as he is not sure in which direction the pressure is to be exerted. Additionally, the closure assembly in the present invention is preferably so configured that the thickness of the disc shaped cap at the raised portion is preferably substantially the same as the vertical distance from the bottom of the v-shaped portion to the above defined substantially horizontal level of the edge, such that the container can be inverted and stably placed on a horizontal surface to act as a tottle. Thus, in this preferred aspect, the raised portion on the disc shaped cap is inventively configured to not only enable easy opening and closing of the closure with a simple horizontal thrust, but also in combination with the preferable aspect of at least 50% of the edge being on a horizontal plane provide further stability to the container to be inverted and placed on a horizontal surface to act as a tottle.

The disc shaped cap is preferably polymeric, more preferably made of PP, HDPE or low density polyethylene (LDPE) and most preferably made of PP. The disc shaped cap could be of any possible shape preferably circular or oval, more preferably circular. It is preferred that the outlet port on the container body is substantially on the same horizontal level as the bottom of the v-shaped portion.

A container of the second aspect of the present invention comprises the container body and the closure assembly as hereinabove defined. The container body and the closure assembly are preferably adapted to be releasably engagable to each. Such a releasable engagement is preferably a snap-fit connection. The snap fit connection may be embodied using a bead and snap assembly between the neck of the container and the lower surface of the container head.

The container and the closure assembly disclosed in the present invention are suitable for dispensing fluid products for use in home and personal care. Preferred products which may be dispensed include shampoos, conditioners, personal wash liquids, detergents, gels, lotions and other liquid solutions. It is preferred that the container and the closure assembly is used to dispense fluid products having a viscosity in the range of 3000 to 25,000 cps at 25° C.

DETAILED DESCRIPTION OF THE FIGURES

FIG. 1 is a perspective view of an embodiment of the container comprising the closure assembly mounted on the container body.

Referring to FIG. 1, the container (2) comprises a closure assembly (1) mounted on a container body (3). The closure assembly (1) comprising a container head (4) and a disc shaped cap (5) while the closure strip(14) is positioned below the disc shaped cap and not seen in this figure. As can be seen in FIG. 1, the container head (4) has upwardly extending walls (6) and a top surface (7). The intersection of the upwardly extending walls and the top surface defines an edge (8). The top surface comprises a curved depressed portion (9). One portion of the edge extends downwardly into a portion of the wall to define a v-shaped portion (12). The disc shaped cap comprises a raised portion (13) at a circumferential part.

Figure 2:
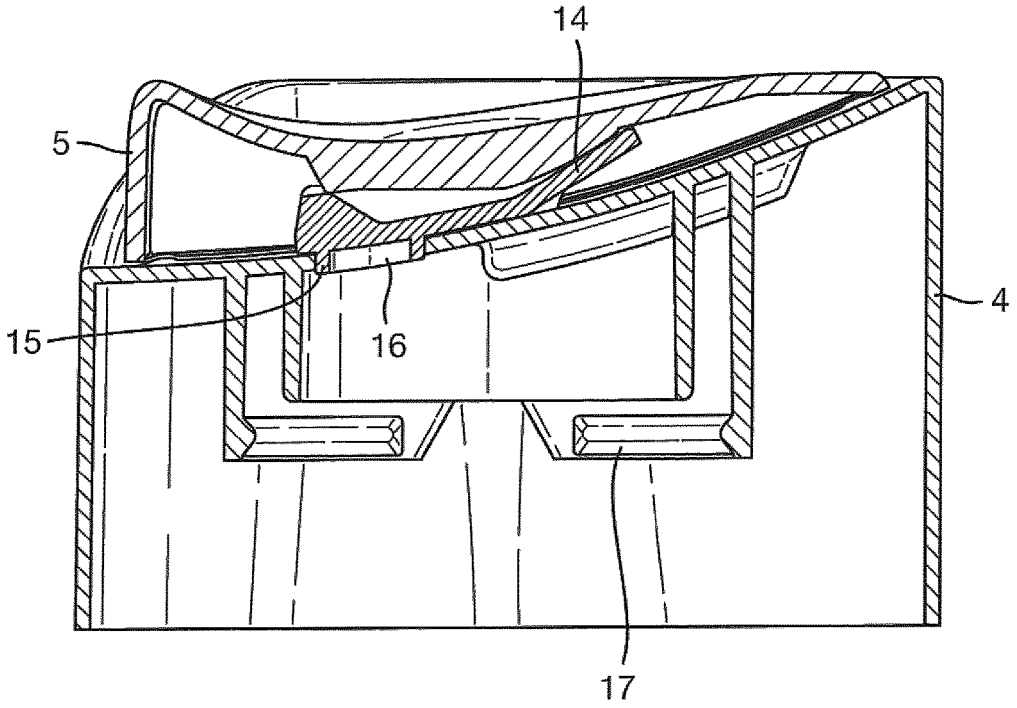
FIG. 2 is the sectional side view of the closure assembly with the various parts in place in the closed position.

FIG. 2 is the sectional side view of the closure assembly with the various parts in place in the closed position.

Referring to FIG. 2, the closure strip (14) is juxtaposed between the disc shaped cap (5) and the container head (4). The closure strip is shown in the closed position where the plug (15) sits flush into the outlet port (16) thereby closing the outlet of the container, thus providing leak-proof closure. The container head (4) is provided on the bottom of the top surface with means for snap-fitting (17) the container head on to the container (not shown).

Figure 3:
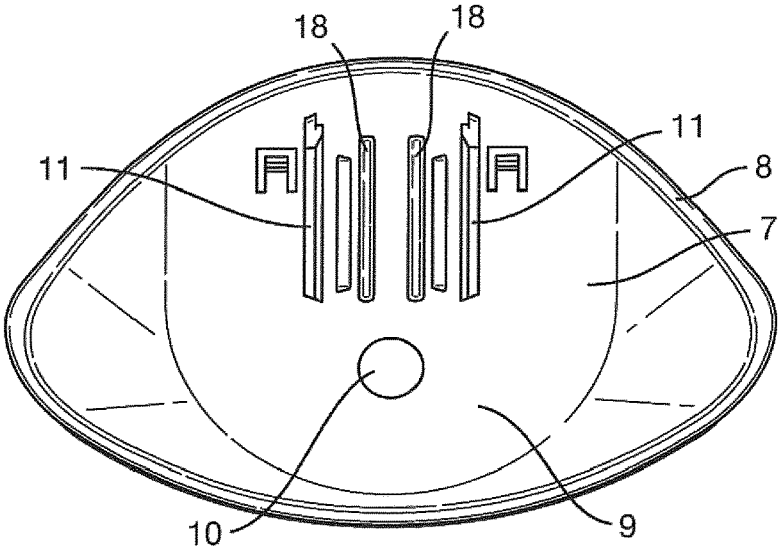
FIG. 3 is the top view of the container head with the disc shaped cap and the closure strip removed.

FIG. 3 is the top view of the container head with the disc shaped cap and the closure strip removed.

Referring to FIG. 3, the top surface of the container head is shown without the disc shaped cap (5) and the closure strip (14). The top surface (7) comprises an outlet port (10) at a curved depressed portion (9) thereof. The top surface (7) of the container head is provided with a pair of parallel tracks (11) and a pair of parallel recesses (18). The top surface of the container head is circumscribed by the edge (8).

Figure 4:
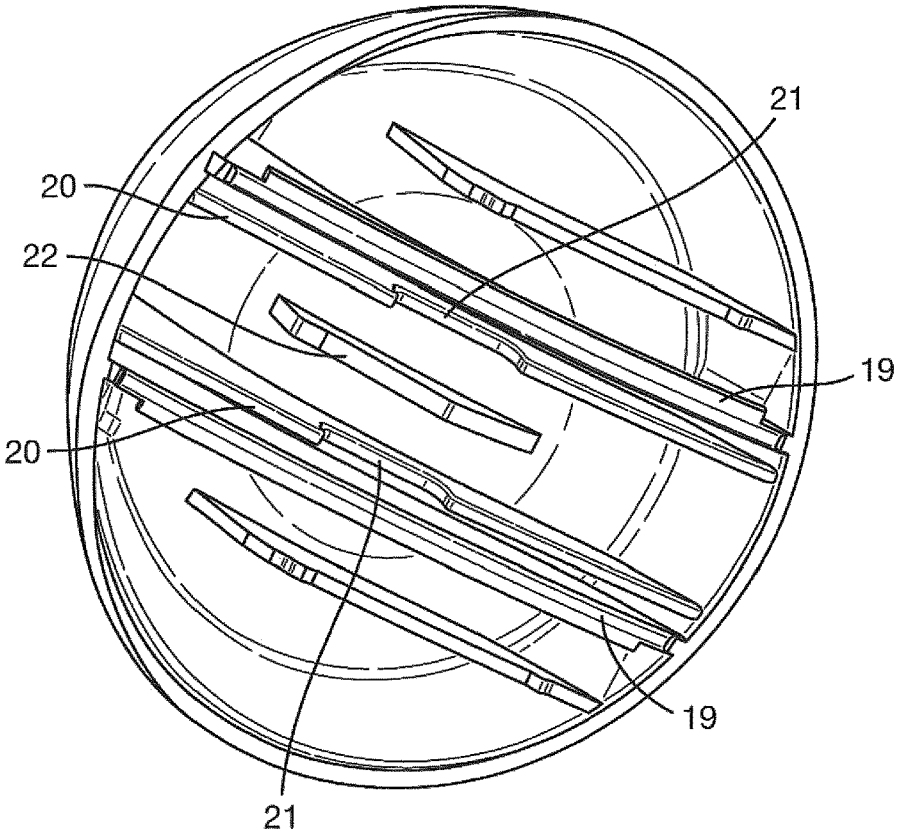
FIG. 4 is the perspective view of the bottom of the disc shaped cap.

FIG. 4 is the perspective view of the bottom of the disc shaped cap.

Referring to FIG. 4, the disc shaped cap is provided at its bottom surface with a first pair of parallel railings (19) adapted to be engaged in a sliding configuration with the pair of parallel tracks (11) shown in FIG. 3. The second pair of parallel railings (20) are provided with rectangular cutouts (21). The bottom surface of the disc shaped cap is also provided with a centrally aligned monorail that has an arcuate profile (22).

Figure 5:
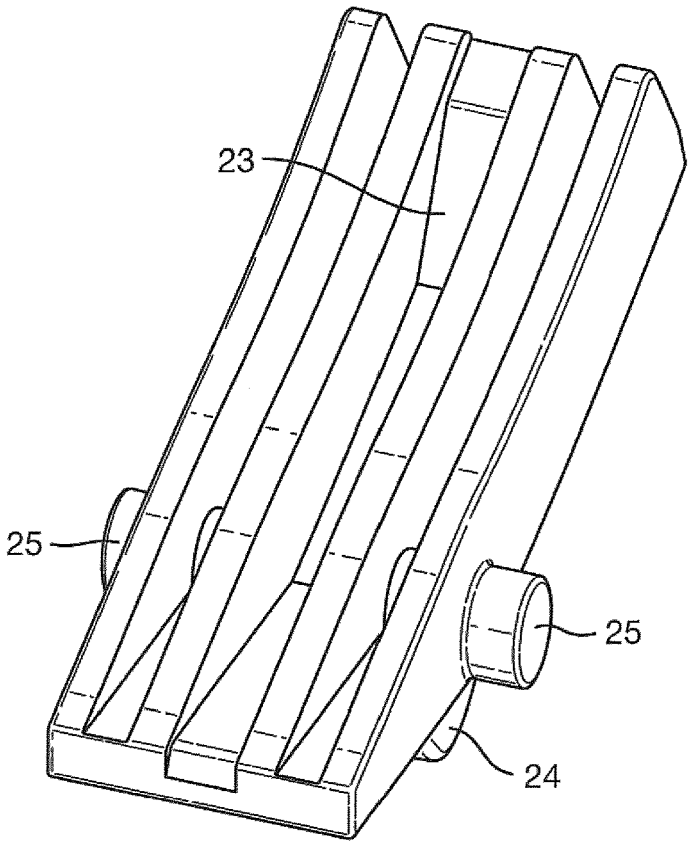
FIG. 5 is the perspective view of the top of the closure strip.
Figure 6:
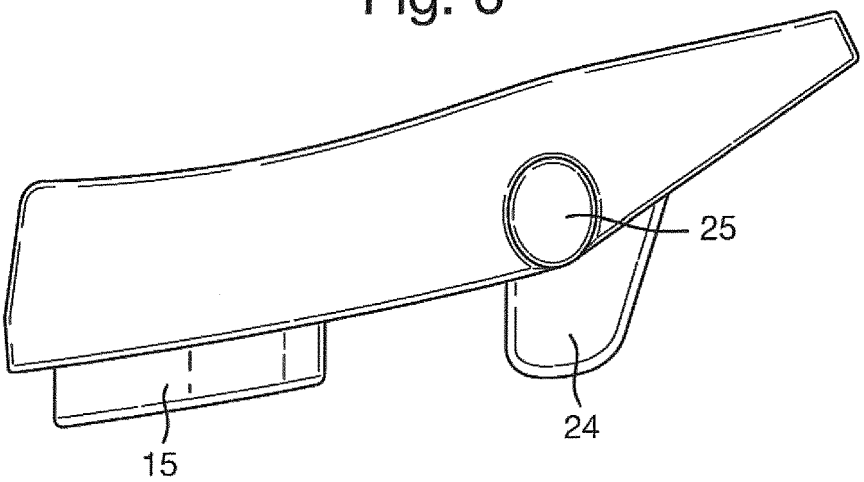
FIG. 6 is the side view of the closure strip.

FIG. 5 is the perspective view and FIG. 6 is a side view of the closure strip.

Referring to FIG. 5 and FIG. 6, the closure strip is an elongate rectangular strip. The upper surface of the closure strip is provided with a longitudinal recess (23) running along the length of the strip. The closure strip is provided on the side edges with a pair of ears (25), only one of which is visible in the view shown in both FIGS. 5 and 6. A pair of legs (24) are provided on the bottom of the closure strip adjacent to the pair of ears. As can be seen in FIG. 6, a plug (15) is provided on the bottom of the closure strip at the other longitudinal end as compared to the pair of ears and the pair of legs.

When in use, to open the container, the raised portion (13) is pushed back in the horizontal direction with a thumb or a finger. The disc shaped cap (5) slides back on the top surface (7) due to the sliding engagement of the parallel tracks (11) with the first pair of parallel railings (19). Simultaneously, the centrally aligned monorail (22) with the arcuate profile causes the closure strip (14) to horizontally slide backwards in the longitudinal recess (23) and pivot vertically with the plug (15) coming unplugged from the outlet port (16). The closure strip thus moves backwards with the pair of legs (24) sliding though the pair of parallel recesses (18) provided on the top surface of the container head (7) and this horizontal movement is limited due to the pair of ears (25) restrained in movement between one end of the rectangular cutout (21) to the other. To close the container, the disc shaped cap is pulled back in the horizontal direction to enable the disc shaped cap and concomitantly the closure strip to move back in the reverse path to cause the plug to sit flush in the outlet port to provide the necessary leak proof closing action.

When the contents of the container are nearly exhausted, the container may be inverted and stably placed on its head to act as a tottle, so as to enable quick and convenient dispensing of even minimal amounts of contents remaining in the container without too much effort on the part of the consumer.

The invention thus provides for a closure system for a container that is easy for the consumer is open and close, is leakproof on closing and can additionally be used as a tottle.

The invention claimed is:

1. A closure assembly for a container to be mounted on a container body comprising (a) a container head;

(b) a disc shaped cap; and (c) a closure strip juxtaposed between said container head and said disc shaped cap;

the container head having upwardly extending walls and a top surface comprising a curved depressed portion comprising an outlet port in fluid communication with said container body; said top surface provided with a pair of parallel tracks and a pair of parallel recesses;

the disc shaped cap provided at its bottom surface with two pairs of parallel railings and a centrally aligned monorail; the first pair of parallel railings slidably engagable with said pair of parallel tracks; the second pair of parallel railings provided with rectangular cutouts; and the centrally aligned monorail is configured to have an arcuate profile;

the closure strip comprising on its upper surface with a longitudinal recess slidably engagable with said arcuate monorail; the closure strip comprising on its lower surface a distal section with a pair of legs slidably engagable with said pair of parallel recesses and at the proximal section with a plug capable of closing the outlet port; the closure strip provided on its side edges with a pair of ears capable of sliding from one end of said rectangular cutouts to the other;

such that when the disc shaped cap is slid over the top surface of the container head from an open position, the arcuate profile of the monorail causes the closure strip to horizontally slide as well as vertically pivot downward to position the plug to close the outlet port and is capable of reversing its path in the opposite direction.

2. A closure assembly as claimed in claim 1 wherein the container head has an edge defined between said upwardly extending walls and said top surface wherein the edge comprises a v-shaped portion extending downwardly into a portion of said wall.

3. A closure assembly as claimed in claim 2 wherein the disc shaped cap comprises a raised portion at a circumferential part thereof.

4. A closure assembly as claimed in claim 3 wherein said raised portion is positioned just posterior to the v-shaped portion, and on the same side of the closure assembly, such that the disc shaped cap can be conveniently slid using a thumb in a horizontal direction through the v-shaped portion of the container head.

5. A closure assembly as claimed in claim 2 wherein at least 50% of the perimeter of the edge is at a substantially horizontal level.

6. A closure assembly as claimed in claim 2 wherein the v-shaped portion constitutes less than 50% of the perimeter of the edge.

7. A closure assembly as claimed in claim 1 wherein the centrally aligned monorail extends over less than 50% of the diameter of the disc shaped cap.

8. A closure assembly as claimed in claim 1 wherein the rectangular cutouts extend over less than 50% of the length of the second pair of railings.

9. A closure assembly as claimed in claim 1 wherein the length of the monorail is longer than the length of the rectangular cutouts.

10. A closure assembly as claimed in claim 1 wherein the container head is made of a rigid plastic selected from PP or HDPE.

11. A closure assembly as claimed in claim 1 wherein the disc shaped cap is made of a rigid plastic selected from PP, HDPE or LDPE.

12. A closure assembly as claimed in claim 1 wherein the closure strip is made of a material selected from glass filled polypropylene, polyamide or any engineering plastic.

13. A container comprising a container body and a closure assembly as claimed in claim 1 adapted to be releasably engagble to each other.

14. A container as claimed in claim 13 wherein the container body and the closure assembly are capable of releasable engagement using a snap-fit connection.

15. A container as claimed in claim 14 wherein said snap fit is embodied using a bead and snap assembly.

* * * * *